United States Patent [19]

Endo et al.

[11] Patent Number: 4,921,448

[45] Date of Patent: May 1, 1990

[54] CONNECTOR TERMINAL RETAINER CONSTRUCTION

[75] Inventors: Takayoshi Endo; Sakai Yagi; Hitoshi Sakai; Hitoshi Saito, all of Shizuoka, Japan

[73] Assignee: Yazaki Corporation, Tokyo, Japan

[21] Appl. No.: 344,563

[22] Filed: Apr. 28, 1989

[30] Foreign Application Priority Data

May 6, 1988 [JP] Japan ..... 63-59414[U]

[51] Int. Cl.[5] ..... H01R 13/40

[52] U.S. Cl. ..... 439/595; 439/592

[58] Field of Search ..... 439/592, 594–598

[56] References Cited

U.S. PATENT DOCUMENTS

| | | | |
|---|---|---|---|
| 4,045,110 | 8/1977 | Sterken | 439/595 |
| 4,614,390 | 9/1986 | Baker | 439/592 |
| 4,721,482 | 1/1988 | Fukuda et al. | 439/595 |
| 4,758,182 | 7/1988 | Anbo et al. | 439/592 |
| 4,776,813 | 10/1988 | Wilson et al. | 439/595 |

*Primary Examiner*—P. Austin Bradley

*Attorney, Agent, or Firm*—Armstrong, Nikaido, Marmelstein, Kubovcik & Murray

[57] ABSTRACT

Described herein is a terminal connector retainer particularly suitable for use with a wire harness connector, which is fittingly interlockable with a rear portion of a connector housing for securely and extractably anchoring terminal members in terminal compartments in the connector housing. The terminal connector basically includes; a frame-like body internally provided with openings for insertion therethrough of wires with terminal members, and a plural number of resilient terminal anchoring fingers extending forwardly into the terminal compartments in the connector housing; the resilient anchoring fingers being capable of restoring an original form by the resiliency thereof when the retainer is in a finally interlocked state, and in the restored original form anchoring the terminal members securely in position in the respective terminal compartments in the connector housing.

10 Claims, 6 Drawing Sheets

CONNECTOR TERMINAL RETAINER CONSTRUCTION

BACKGROUND OF THE INVENTION

1. Field of the Invention

The present invention relates to a wire harness connector, and more particularly to a terminal retainer construction for fixedly anchoring in position the terminal members which are inserted into terminal compartments in a wire harness connector housing.

2. Prior Art

For fixing in position the terminal members which are inserted into terminal compartments in a connector housing, it has been the general practice to provide flexible or resilient retainer arms integrally on the inner wall surfaces of each terminal compartment, which retainer arms engage the terminal members upon insertion of the terminal members into the terminal compartments to prevent dislocation or dislodgement of the terminal members. Recently, a proposal has been made to provide a terminal retainer which is fittingly interlockable with a rear portion of the connector housing to prevent dislocation or dislodgement of the terminal members securely in cooperation with or in place of the flexible retainer arms.

FIG. 9 illustrates such a prior art retainer structure, which is provided with support projections d on the inner surfaces of opposing wall portions c of each terminal compartment b in a connector housing a. Tapered drive surface e are formed on the rear side of the support projections d, while temporary or provisional locking projections f and main locking projections g are provided in relatively rearward and forward positions on the outer wall surfaces with respect to the position of the housing a.

Indicated at h is a frame-like terminal retainer with resilient locking arms j and resilient retainer arms k extending forwardly from a frame body i respectively onto and into a connector housing a to be connected therewith.

The terminal retainer h is firstly joined with the housing a in a provisionally interlocked state where the resilient locking arms j are in interlocking engagement with the provisional locking projections f. In this state, the resilient retainer arms k are extended linearly forward without interfering with a terminal member l inserted into the terminal compartment b.

Nextly, the terminal retainer h is pushed in further to bring the retainer into a finally interlocked state where the resilient locking arms j are in interlocking engagement with the main locking projections g. In this state, the fore ends $k_1$ of the resilient retainer arms k which are abutted against the tapered drive surfaces e are thereby bent inward to grip a terminal press-on wire portion m, and located behind support projections n and o of the terminal member l to prevent its dislocation in the rearward direction.

In the above-described prior art arrangement, the resilient retainer arms k of the terminal retainer h which stop the terminal member l are forcibly deformed against its resiliency and retained in the deformed state by the tapered drive surfaces e, and therefore they are apt to be fixed in the deformed state losing resiliency under influence of heat. Such a non-resilient deformation makes it difficult to extract the terminal member or to re-insert the retainer member due to the interference of the deformed retainer arms k with the terminal member.

SUMMARY OF THE INVENTION

In view of the foregoing situations, the present invention has as its object the provision of a connector terminal retainer which can eliminate the drawbacks of the prior art construction as discussed above. More specifically, it is an object of the present invention to provide a connector terminal retainer, wherein the terminal retainer to be fitted on a connector housing is provided with resilient retainer arms which are in an interfering position relative to terminal members being inserted into the connector housing to assume a provisionally interlocked state but which, after permitting insertion of the terminal members by resilient deformation, restore an original form when pushed into a finally interlocked state anchoring the terminal members fixedly in position, thus eliminating the problem of the conventional resilient retainer arms which become unusable due to permanent deformation.

In accordance with the present invention, in order to achieve the above-mentioned objects, there is provided a connector terminal retainer of the type including a connector housing having a plural number of terminal compartments, terminal members to be inserted into the compartments, and a terminal retainer fittingly interlockable with a rear portion of the connector housing stepwise through two stages; a stage of provisional interlocking and a stage of final interlocking, characterized in that the terminal retainer comprises a frame-like body with openings for insertion of the terminal members and resilient terminal-anchoring fingers extending forwardly into the terminal compartments, the resilient fingers being capable of restoring an original form by the resiliency thereof after insertion of the terminal members to anchor securely in the respective terminal compartments of the connector housing in the finally interlocked state of the terminal retainer free of the problem of permanent deformation.

The above and other objects, features and advantages of the invention will become apparent from the following description and the appended claims, taken in conjunction with the accompanying drawings which show by way of example preferred embodiments of the invention.

DETAILED DESCRIPTION OF PREFERRED EMBODIMENTS

Figure 1:
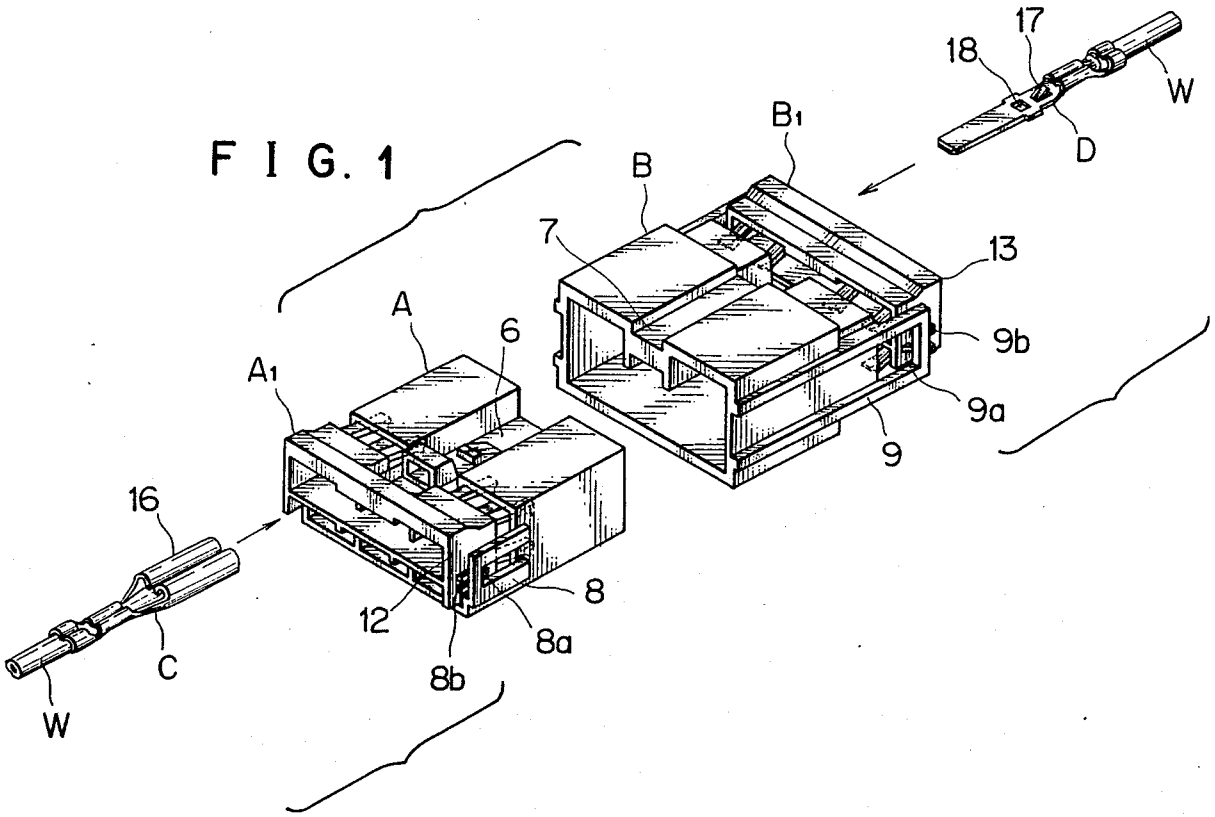
FIG. 1 is a perspective view of an embodiment of the invention, showing male and female connector housings which are provisionally interlocked with the respective terminal retainers.

Referring to FIG. 1 through 4, there is illustrated an embodiment of the invention, in which indicated at A is a male connector housing of a synthetic resin material, and at B is a female connector housing similarly of a synthetic resin material. Separately formed terminal retainers $A_1$ and $B_1$ are fitted on rear portions of the male and female connector housings A and B respectively. The connector housings A and B are provided with a plural number of terminal compartments 1 and 2 in two rows, namely, in upper and lower rows, receiving female type terminal members C in the terminal compartments of the male connector housing A and receiving male type terminal members D in the terminal compartments of the female connector housing B.

The terminal compartment 1 is provided with a stopper 3 at its front end and, integrally with its inner wall surface, with a resilient terminal holding finger 4, while the terminal compartment 2 is provided with a resilient terminal holding finger 5 integrally with its inner wall in addition to a stopper (not shown) located in an intermediate position.

Provided on the top side of the male connector housing A is a resilient locking arm 6 and provided with a locking projection **6*a* and an operating projection 6*b*. Opposingly to the resilient locking arm 6, the female connector housing B is provided with a locking portion 7 for engagement with the locking projection 6*a*. Further, the male and female connector housings A and B are provided with rearwardly extending resilient locking arms 8 and 9** at the opposite sides, respectively.

The terminal retainers $A_1$ and $B_1$ have frame-like main bodies 12 and 13 which internally define openings 10 and 11 to insert the terminal members C and D therethrough along with wires W connected to the respective terminal members, and which have forwardly extending resilient terminal anchoring fingers 14 and 15 opposingly to the corresponding terminal compartments 1 and 2 in the upper and lower compartment rows of the male and female connector housings A and B. The main bodies 12 and 13 of the terminal retainers $A_1$ and $B_1$ are provided with provisional locking projections **8*a* and 9*a* and main locking projections 8*b* and 9*b* at the opposite sides which are successively engageable with the resilient locking arms 8 and 9** of the male and female connector housings A and B, respectively.

Figure 4:
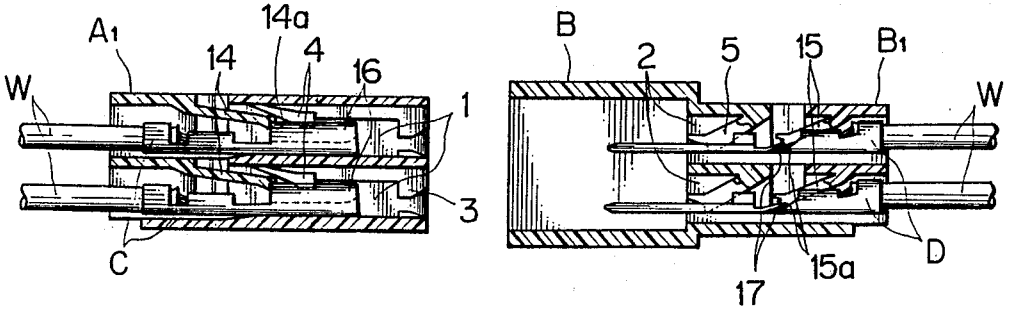
FIG. 4 is a sectional view of the male and female housings and the terminal retainers in provisionally interlocked state.

Prior to insertion of the terminal members C and D, the connector housings A and B and the terminal retainers $A_1$ and $B_1$ are assembled into a provisionally interlocked state, with the resilient locking arms 8 and 9 in interlocking engagement with the provisional locking projections **8*a* and 9*a* as shown particularly in FIG. 1. In this state, the terminal members C and D are inserted into the terminal compartments 1 and 2 through the openings in the terminal retainers $A_1$ and $B_1$. At this time, the inserted terminal members C and D cause the resilient terminal anchoring fingers 14 and 15, which are in an interfering position, to flex outward by flexural deformation against the resilient force of the resilient fingers 14 and 15. In the male connector housing A, the female type terminal members C are held in abutting engagement with stepped locking portions 14*a* of the resilient fingers 14 as soon as electric contact portions of the terminal members C ride over the resilient fingers 14. On the other hand, in the female connector housing B, the male type terminal members D are held in abutting engagement with stepped locking portions 15*a* of the resilient fingers 15 as soon as locking projections 17, which are formed by slitting intermediate portions of the male type terminal members D, ride over the resilient terminal anchoring fingers 15 (FIG. 4**).

Figure 2:
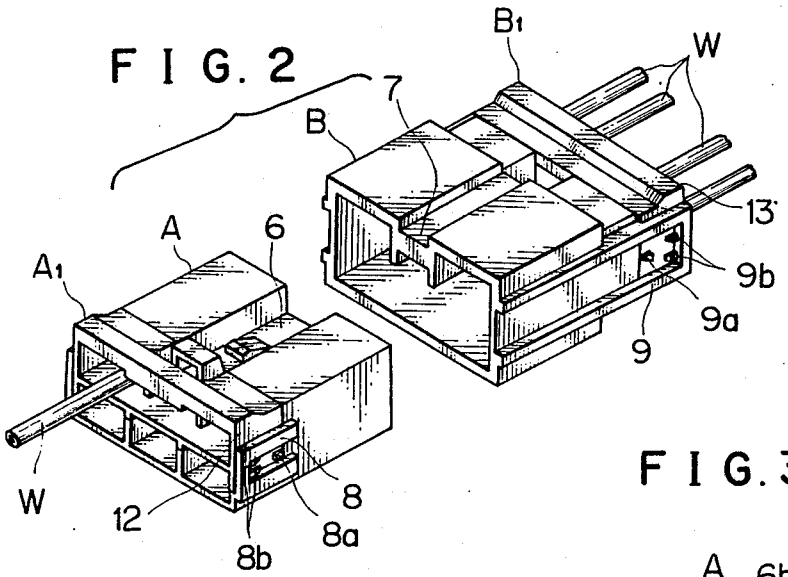
FIG. 2 is a view similar to FIG. 1 but showing the connector housings and terminal retainers in finally interlocked state.
Figure 3:
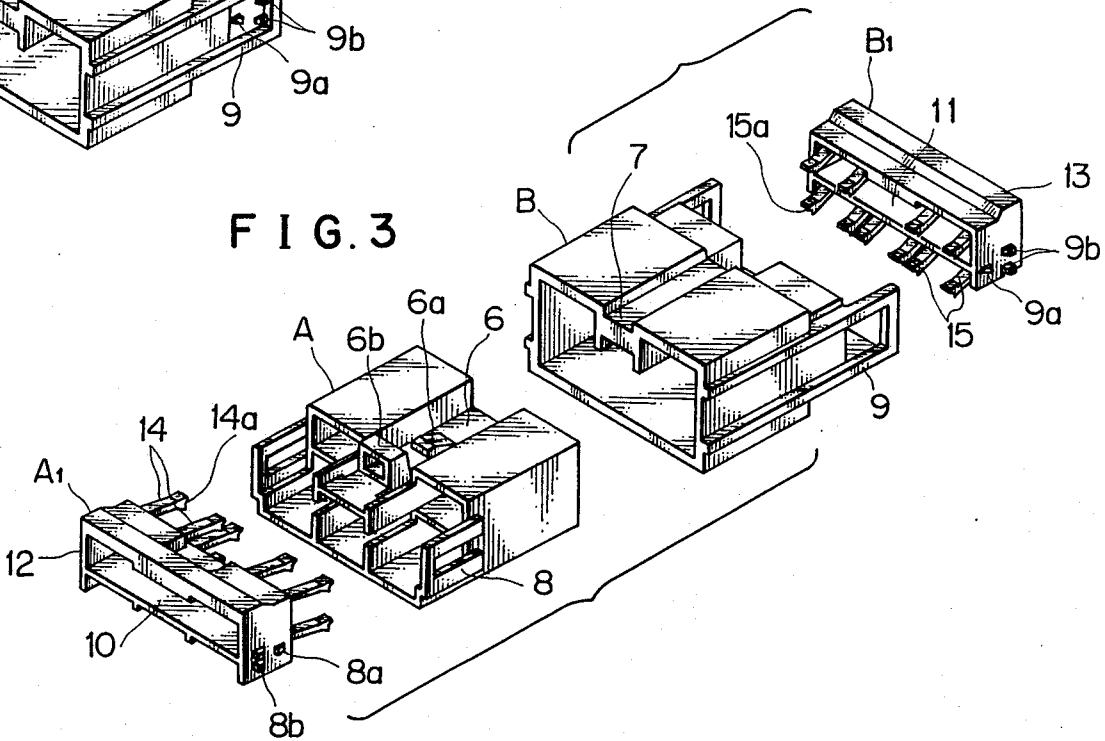
FIG. 3 is a view similar to FIG. 1 but showing the connector housings and terminal retainers in separated state.
Figure 5:
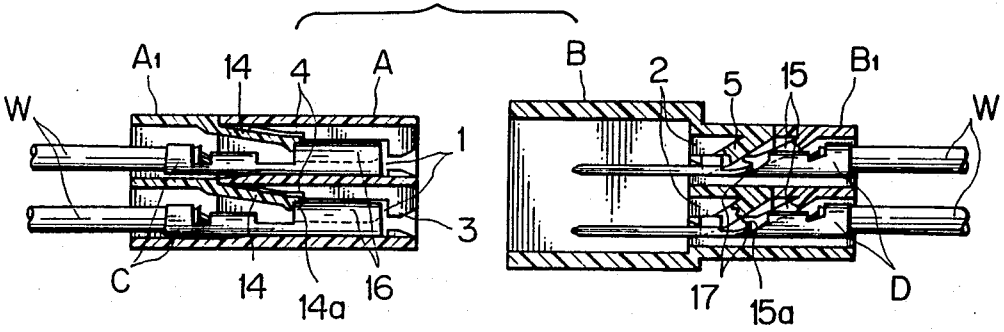
FIG. 5 is a view similar to FIG. 4 but showing the two housings and terminal retainers in finally interlocked state.

Nextly, the terminal retainers $A_1$ and $B_1$ are pushed into the connector housings A and B until the resilient locking arms 8 and 9 engage with the main locking projections **8*b* and 9*b* to hold the retainers in a finally interlocked state (FIG. 2). By so doing, the resilient fingers 14 and 15 in engagement with the terminal members C and D push the latter into the respective terminal compartments 1 and 2 to engage the resilient terminal holding fingers 4 with the electric contact portions 16 in the connector housings A and engage the resilient terminal holding fingers 5 with locking holes 17 in the connector housing B(FIG. 5). The provisional locking projections 8*a* and 9*a* and main locking projections 8*b* and 9*b* are each provided with a tapered guide surface on the forwardly side, so that the resilient locking arms 8 and 9 can ride over these projections when the retainers are pushed in, through flexural deformation of the locking arms 8 and 9**.

In the provisionally interlocked state, the terminal members C and D can be immediately engaged with the resilient terminal holding fingers 4 and 5 in the connector housings A and B by further pushing them into the respective terminal compartments. Even when the terminal member C and D are in an incompletely inserted state, they can be driven into engagement with the resilient terminal holding fingers 4 and 5 as the terminal retainers $A_1$ and $B_1$ are pushed into the finally interlocked state.

Figure 6:
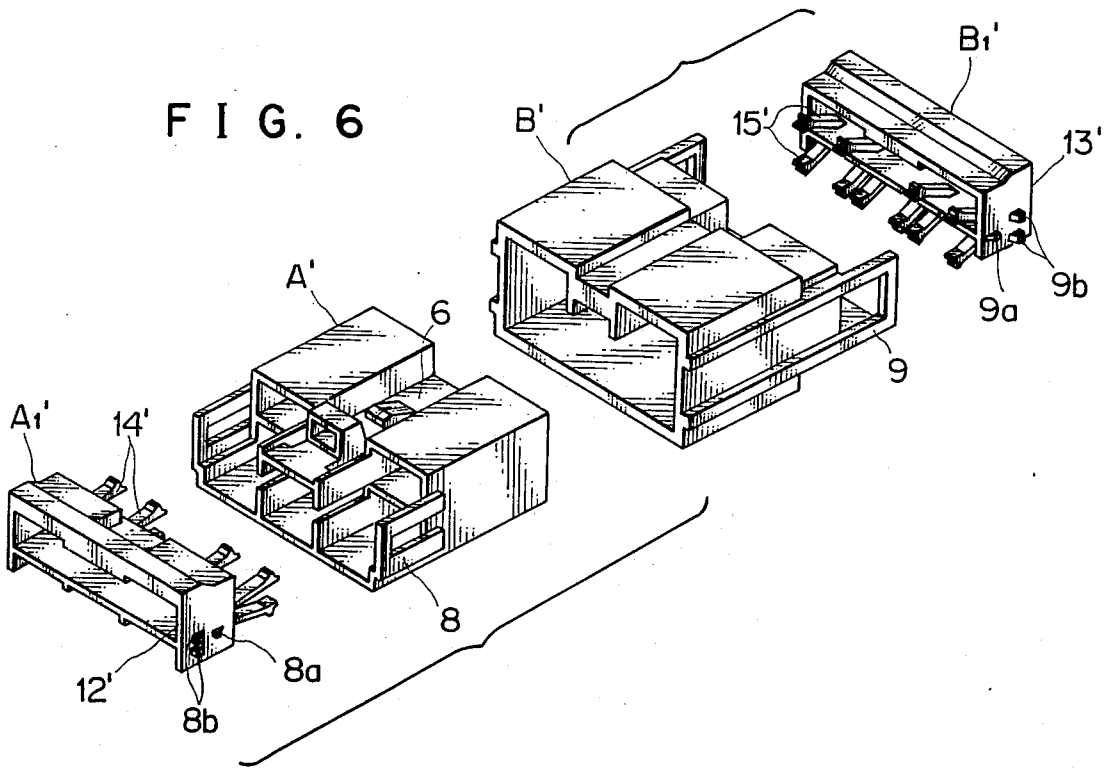
FIG. 6 is a perspective view of another embodiment of the invention, showing the connector housings and terminal retainers in separated state.
Figure 7:
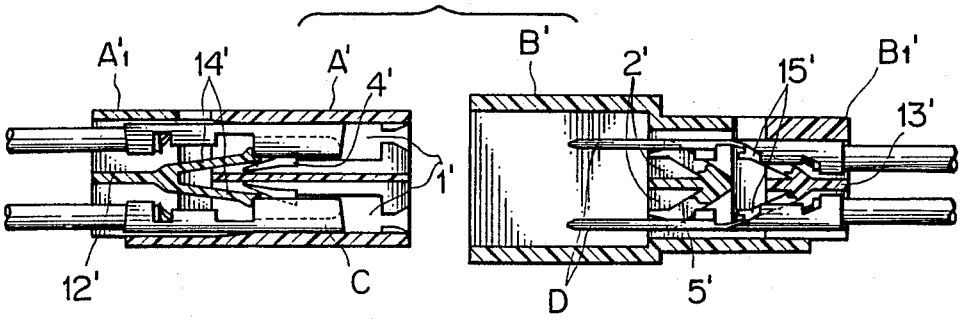
FIG. 7 is a sectional view of the connector housings and terminal retainers of FIG. 6 in provisionally interlocked state.
Figure 8:
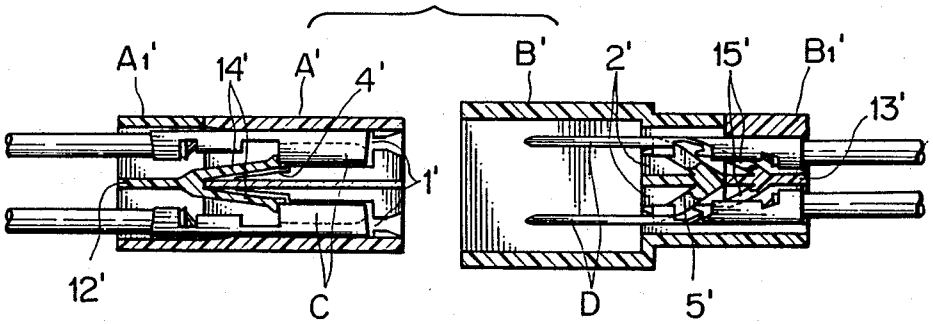
FIG. 8 is a sectional view of the same connector housings and terminal retainers in finally interlocked state.
Figure 9:
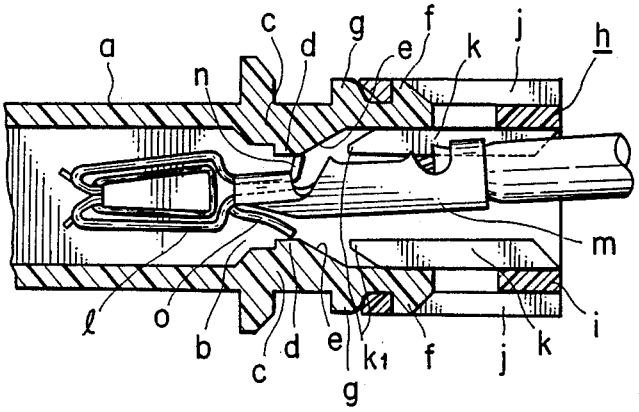
FIG. 9 PRIOR ART
FIG. 9 is a sectional view of conventional connector housings and terminal retainers in provisionally interlocked state.
Figure 10:
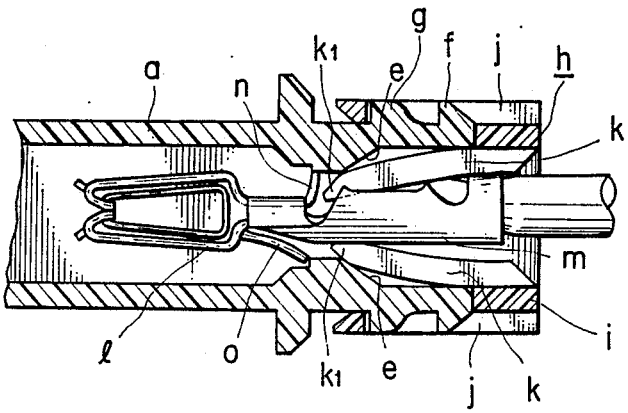
FIG. 10 PRIOR ART
FIG. 10 is a view similar to FIG. 9 but showing the connector housings and terminal retainers in finally interlocked state.

Referring to FIGS. 6 through 8, there is illustrated another embodiment of the invention, wherein resilient terminal holding fingers 4' and 5' in the upper and lower terminal compartments 1' and 2' of the male and female connector housings A' and B' are formed to extend upwardly and downwardly in a diverging fashion from a wall which partitions the upper and lower terminal compartments 1' and 2', respectively. In the same manner as in the foregoing embodiments, these resilient terminal holding fingers 4' and 5' engage the female and male type terminal members C and D which are inserted symmetrically in face-to-face relation into the upper and lower terminal compartments 1' and 2'.

In this instance, the terminal retainers $A_1$ and $B_1$ are provided with a plural number of upwardly and downwardly diverging resilient terminal anchoring fingers 14' and 15' to engage the terminal members C and D in the same manner as in the first embodiment described above.

As described heretoabove, the connector terminal retainer construction of the present invention consists of a combination of a connector housing with a number of terminal compartments, terminal members to be inserted into the terminal compartments, and a terminal retainer to be fittingly interlocked with a rear portion of the connector housing through two stages; a stage of provisional interlocking and a stage of final interlocking. The terminal retainer is provided with openings for insertion of the terminal members and resilient terminal anchoring fingers extending into the terminal compartments in the connector housing, each one of the resilient fingers being capable of restoring its original form by its own resiliency in the finally interlocked position in engagement with a terminal member. Thus, the resilient terminal anchoring fingers retain resiliency while in engagement with the terminal members in the respective locking positions, without losing resiliency. It is followed by the fact that, even when the terminal members are inserted and extracted repeatedly, the resilient fingers can be easily displaced upon abutment thereon of a terminal member, facilitating insertion and extraction of the terminal members while holding them securely in fixed state in the interlocked position of the retainer.

What is claimed is:

1. A connector terminal retaining structure of the type including a connector housing having a plural number of terminal compartments, terminal members inserted in said terminal compartments, and a connector retainer fittingly interlockable with a rear portion of said connector housing through two stages of provisional interlocking and final interlocking, wherein said connector terminal retainer comprises;

a frame-like body internally provided with openings for insertion therethrough of wires with said terminal members, and a plural number of resilient terminal anchoring fingers extending forwardly into said terminal compartments in said connector housing;

said resilient anchoring fingers being capable of restoring an original form by the resiliency thereof when said retainer is advanced into said final interlocking stage, and in the restored original form holding said terminal members securely in position in said terminal compartments in said connector housing.

2. A connector terminal retaining structure as defined in claim 1, wherein said resilient anchoring fingers are each provided with a stepped locking portion at the fore end thereof for engagement with a complementary locking portion on a corresponding terminal member.

3. A connector terminal retaining structure as defined in claim 1, wherein said connector housing is provided with said terminal compartments in two rows, and said terminal retainer is provided with said resilient terminal anchoring fingers correspondingly in two rows.

4. A connector terminal retaining structure as defined in any one of claims 1 to 3, wherein said connector housing is a female connector housing of a wire harness connector and formed by injection molding of a synthetic resin material, said female connector housing receiving male type terminal members in said terminal compartments.

5. A connector terminal retaining structure as defined in any one of claims 1 to 3, wherein said terminal retainer is provided with provisional and main locking projections on the opposite lateral sides thereof for stepwise interlocking engagement with resilient locking arms extending rearward from the opposite lateral sides of said connector housing.

6. A connector terminal retaining structure as defined in claim 5, wherein said provisional and main locking projections are provided with a tapered surface on the front side to permit said resilient locking arms of said connector housing to ride over said locking projections stepwise in reaching said provisional and final interlocking stages.

7. A connector terminal retaining structure as defined in any one of claims 1 to 3, wherein said connector housing is male connector housing of a wire harness connector and formed by injection molding of a synthetic resin material, said male connector housing receiving female type terminal members in said terminal compartments.

8. A connector terminal retaining structure as defined in claim 7, wherein said male connector housing is adapted to slidably mate with a female connector housing, said male connector housing is provided with a resilient locking arm on the top side thereof, said locking arm being formed with an operating projection and a locking projection resiliently engageable with a complementary locking portion provided on said female connector housing.

9. A connector terminal retaining structure as defined in any one of claims 1 to 3, wherein said connector housing is provided with a resilient terminal holding finger formed integrally on an inner wall surface of each terminal compartment and extended obliquely to hold a terminal member inserted therein in cooperation with said resilient locking finger of said terminal retainer.

10. A connector terminal retaining structure as defined in claim 9, wherein said terminal members are inserted symmetrically in face-to-face relation in upper and lower terminal compartments of said connector housing, and said connector housing is provided with resilient terminal holding fingers extending divergingly into said upper and lower terminal compartments from a wall partitioning said upper and lower compartments.

* * * * *